US005956974A

United States Patent [19]

Agrawal et al.

[11] Patent Number: 5,956,974

[45] Date of Patent: Sep. 28, 1999

[54] MULTIPLE EXPANDER PROCESS TO PRODUCE OXYGEN

[75] Inventors: Rakesh Agrawal, Emmaus; Donn Michael Herron, Fogelsville; Yanping Zhang, Wescosville, all of Pa.

[73] Assignee: Air Products and Chemicals, Inc., Allentown, Pa.

[21] Appl. No.: 09/010,965

[22] Filed: Jan. 22, 1998

[51] Int. Cl.[6] ..... F25J 3/00

[52] U.S. Cl. ..... 62/646; 62/652

[58] Field of Search ..... 62/646, 652

[56] References Cited

U.S. PATENT DOCUMENTS

| | | | |
|---|---|---|---|
| 2,753,698 | 7/1956 | Jakob | 62/123 |
| 4,410,343 | 10/1983 | Ziemer | 62/29 |
| 4,704,148 | 11/1987 | Kleinberg | 62/24 |
| 4,883,519 | 11/1989 | Agrawal et al. | 62/652 |
| 4,936,099 | 6/1990 | Woodward et al. | 62/24 |
| 5,146,756 | 9/1992 | Lavin | 62/24 |
| 5,309,721 | 5/1994 | Rathbone | 62/39 |
| 5,396,772 | 3/1995 | McKeigue et al. | 62/652 |

FOREIGN PATENT DOCUMENTS

| | | | |
|---|---|---|---|
| 2854508 | 6/1980 | Germany | F25J 3/02 |
| 8800677 | 1/1988 | WIPO | F25J 3/02 |

*Primary Examiner*—Ronald Capossela
*Attorney, Agent, or Firm*—Willard Jones III

[57] ABSTRACT

The present invention relates to a process for the cryogenic distillation of air in a distillation column system that contains at least one distillation column wherein the boil-up at the bottom of the distillation column producing the oxygen product is provided by condensing a stream whose nitrogen concentration is equal to or greater than that in the feed air stream, which comprises the steps of: (a) generating work energy which is at least ten percent (10%) of the overall refrigeration demand of the distillation column system by at least one of the following two methods: (1) work expanding a first process stream with nitrogen content equal to or greater than that in the feed air and then condensing at least a portion of the expanded stream by latent heat exchange with at least one of the two liquids: (i) a liquid at an intermediate height in the distillation column producing oxygen product and (ii) one of the liquid feeds to this distillation column having an oxygen concentration equal to or preferably greater than the concentration of oxygen in the feed air; and (2) condensing at least a second process stream with nitrogen content equal to or greater than that in the feed air by latent heat exchange with at least a portion of an oxygen-enriched liquid stream which has oxygen concentration equal to or preferably greater than the concentration of oxygen in the feed air and which is also at a pressure greater than the pressure of the distillation column producing oxygen product.

21 Claims, 8 Drawing Sheets

MULTIPLE EXPANDER PROCESS TO PRODUCE OXYGEN

BACKGROUND OF THE INVENTION

The present invention relates to several methods for efficient production of oxygen by cryogenic air separation. In particular, the present invention relates to cryogenic air separation processes where it is attractive to produce at least a portion of the total oxygen with purity less than 99.5% and, preferably, less than 97%.

There are numerous U.S. patents that teach the efficient production of oxygen with purity less than 99.5%. Two examples are U.S. Pat. Nos. 4,704,148 and 4,936,099.

U.S. Pat. No. 2,753,698 discloses a method for the fractionation of air in which the total air to be separated is prefractionated in the high pressure column of a double rectifier to produce a crude (impure) liquid oxygen (crude LOX) bottoms and a gaseous nitrogen overhead. The so produced crude LOX is expanded to a medium pressure and is completely vaporized by heat exchange with condensing nitrogen. The vaporized crude oxygen is then slightly warmed, expanded against a load of power production and scrubbed in the low pressure column of the double rectifier by the nitrogen condensed within the high pressure column and entered on top of the low pressure column. The bottom of the low pressure column is reboiled with the nitrogen from the high pressure column. This method of providing refrigeration will henceforth be referred to as CGOX expansion. In this patent, no other source of refrigeration is used. Thus, the conventional method of air expansion to the low pressure column is replaced by the proposed CGOX expansion. As a matter of fact, it is cited in this patent that the improvement results because additional air is fed to the high pressure column (as no gaseous air is expanded to the low pressure column) and this results in additional nitrogen reflux being produced from the top of the high pressure column. It is stated that the amount of additional nitrogen reflux is equal to the additional amount of nitrogen in the air that is fed to the high pressure column. An improvement in the efficiency of scrubbing with liquid nitrogen in the upper part of the low pressure column is claimed to overcome the deficiency of boil-up in the lower part of the low pressure column.

U.S. Pat. No. 4,410,343 discloses a process for the production of low purity oxygen which employs a low pressure and a medium pressure column, wherein the bottoms of the low pressure column are reboiled against condensing air and the resultant air is fed into both the medium pressure and low pressure columns.

U.S. Pat. No. 4,704,148 discloses a process utilizing high and low pressure distillation columns for the separation of air to produce low purity oxygen and a waste nitrogen stream. Feed air from the cold end of the main heat exchangers is used to reboil the low pressure distillation column and to vaporize the low purity oxygen product. The heat duty for the column reboil and oxygen product vaporization is supplied by condensing air fractions. In this patent, the air feed is split into three substreams. One of the substreams is totally condensed and used to provide reflux to both the low pressure and high pressure distillation columns. A second substream is partially condensed with the vapor portion of the partially condensed substream being fed to the bottom of the high pressure distillation column and the liquid portion providing reflux to the low pressure distillation column. The third substream is expanded to recover refrigeration and then introduced into the low pressure distillation column as column feed. Additionally, the high pressure column condenser is used as an intermediate reboiler in the low pressure column.

In international patent application #PCT/US87/01665 (U.S. Pat. No. 4,796,431), Erickson teaches a method of withdrawing a nitrogen stream from the high pressure column, partially expanding this nitrogen to an intermediate pressure and then condensing it by heat exchange against either crude LOX from the bottom of the high pressure column or a liquid from an intermediate height of the low pressure column. This method of refrigeration will now be referred to as nitrogen expansion followed by condensation (NEC). Generally, NEC provides the total refrigeration need of the cold box. Erickson teaches that only in those applications where NEC alone is unable to provide the refrigeration need that supplemental refrigeration is provided through the expansion of some feed air. However, use of this supplemental refrigeration to reduce energy consumption is not taught. This supplemental refrigeration is taught in the context of a flowsheet where other modifications to the flowsheets were done to reduce the supply air pressure. This reduced the pressure of the nitrogen to the expander and therefore the amount of refrigeration available from NEC.

In U.S. Pat. No. 4,936,099, Woodward, et al. use CGOX expansion in conjunction with the production of low purity oxygen. In this case, gaseous oxygen product is produced by vaporizing liquid oxygen from the bottom of the low pressure column by heat exchange against a portion of the feed air.

In DE-28 54 508, a portion of the air feed at the high pressure column, pressure is further compressed at the warm level by using work energy from the expander providing refrigeration to the cold box. This further compressed air stream is then partially cooled and expanded in the same expander that drives the compressor. In this scheme, the fraction of the feed air stream which is further compressed and then expanded for refrigeration is the same. As a result, for a given fraction of the feed air, more refrigeration is produced in the cold box. The patent teaches two methods to exploit this excess refrigeration: (a) to produce more liquid products from the cold box; (b) to reduce flow through the compressor and the expander and thereby increase flow to the high pressure column. It is claimed that an increased flow to the high pressure column would result in a greater product yield from the cold box.

In U.S. Pat. No. 5,309,721, the low pressure column of a double column process is operated at a pressure much higher than the atmospheric pressure. The resulting nitrogen stream from the top of the low pressure column is divided into two streams and each stream is expanded in a different expander operating at different temperature levels.

The U.S. Pat. No. 5,146,756 also teaches the use of two expanders to obtain large temperature differences between the cooling and warming streams in the main heat exchanger that cools the feed air stream for distillation. This is done to reduce the number of main heat exchanger cores. However, in order to operate two expanders, the low pressure column is run at pressures greater than 2.5 bar and a portion of the nitrogen exiting from the top of the low pressure column is expanded in one of the expanders. A portion of the feed air is expanded in the second expander to the low pressure column.

BRIEF SUMMARY OF THE INVENTION

The present invention relates to a process for the cryogenic distillation of air in a distillation column system that contains at least one distillation column wherein the boil-up at the bottom of the distillation column producing the oxygen product is provided by condensing a stream whose nitrogen concentration is equal to or greater than that in the feed air stream, which comprises the steps of: (a) generating work energy which is at least ten percent (10%) of the overall refrigeration demand of the distillation column system by at least one of the following two methods: (1) work expanding a first process stream with nitrogen content equal to or greater than that in the feed air and then condensing at least a portion of the expanded stream by latent heat exchange with at least one of the two liquids: (i) a liquid at an intermediate height in the distillation column producing oxygen product and (ii) one of the liquid feeds to this distillation column having an oxygen concentration equal to or preferably greater than the concentration of oxygen in the feed air; and (2) condensing at least a second process stream with nitrogen content equal to or greater than that in the feed air by latent heat exchange with at least a portion of an oxygen-enriched liquid stream which has oxygen concentration equal to or, preferably, greater than the concentration of oxygen in the feed air and which is also at a pressure greater than the pressure of the distillation column producing oxygen product, and after vaporization of at least a portion of oxygen-enriched liquid into a vapor fraction due to latent heat exchange, work expanding at least a portion of the resulting vapor stream; (b) work expanding a third process stream to produce additional work energy such that the total work generated along with step (a) exceeds the total refrigeration demand of the cryogenic plant and if the third process system is the same as the first process system in step (a)(1), then at least a portion of the third process stream after work expansion is not condensed against either of the two liquid streams described in step (a)(1).

BRIEF DESCRIPTION OF SEVERAL VIEWS OF THE DRAWINGS

In FIGS. 1 through 6, common streams use the same stream reference numbers.

DETAILED DESCRIPTION OF THE INVENTION

Figure 1:
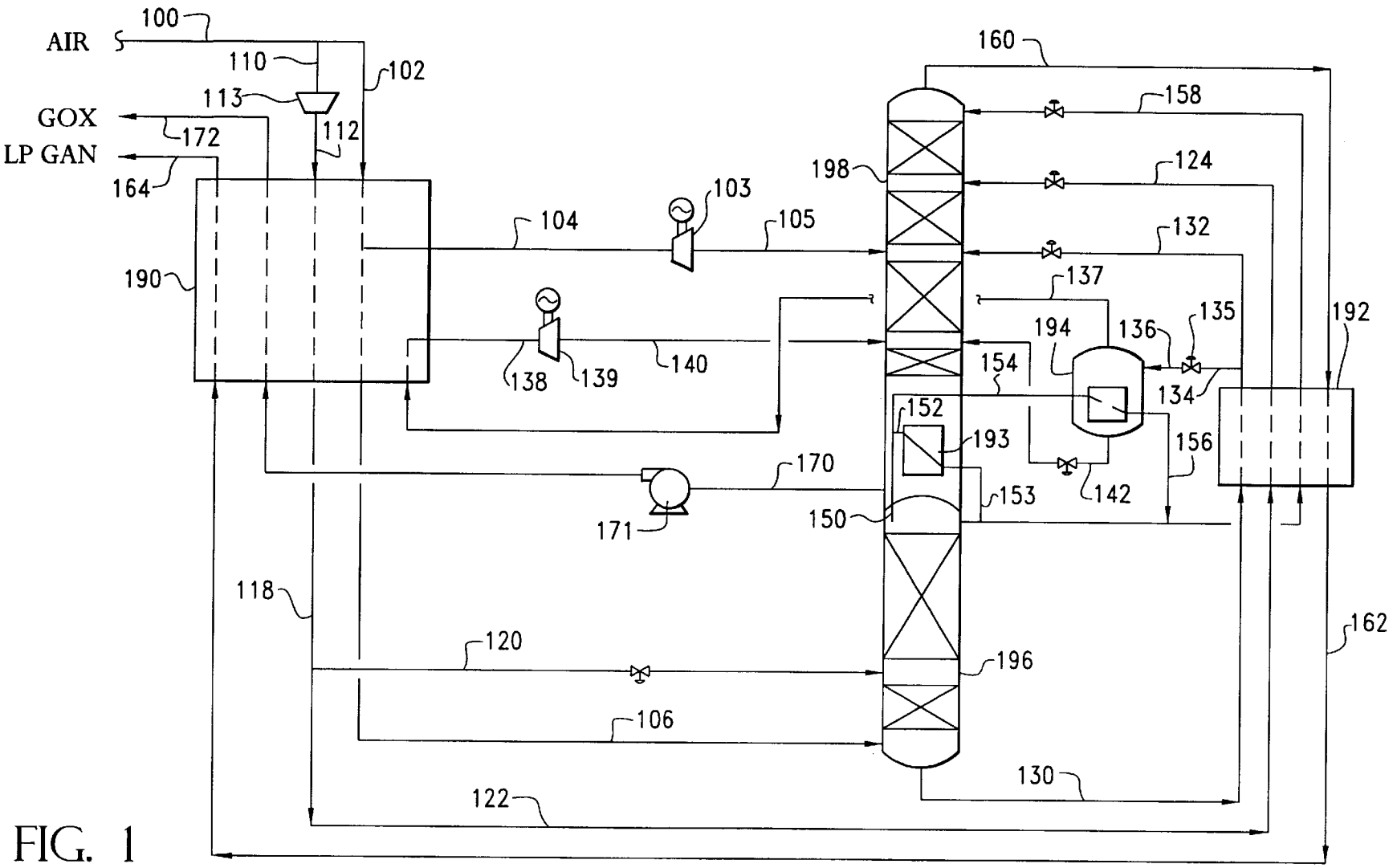
FIGS. 1 through 6 illustrate schematic diagrams of different embodiments of the present invention.

The present invention teaches more energy efficient and cost effective cryogenic process for the production of low purity oxygen. The low-purity oxygen is defined as a product stream with oxygen concentration less than 99.5% and preferably less than 97%. In this method, the feed air is distilled by a distillation system that contains at least one distillation column. The boil-up at the bottom of the distillation column producing the oxygen product is provided by condensing a stream whose nitrogen concentration is either equal to or greater than that in the feed air stream. The invention is comprised of the following steps:

(a) generating work energy which is at least ten percent (10%) of the overall refrigeration demand of the distillation column system by at least one of the following two methods:

(1) work expanding a first process stream with nitrogen content equal to or greater than that in the feed air and then condensing at least a portion of the expanded stream by latent heat exchange with at least one of the two liquids: (i) a liquid at an intermediate height in the distillation column producing oxygen product and (ii) one of the liquid feeds to this distillation column having an oxygen concentration equal to or preferably greater than the concentration of oxygen in the feed air; and (2) condensing at least a second process stream with nitrogen content equal to or greater than that in the feed air by latent heat exchange with at least a portion of an oxygen-enriched liquid stream which has oxygen concentration equal to or preferably greater than the concentration of oxygen in the feed air and which is also at a pressure greater than the pressure of the distillation column producing oxygen product, and after vaporization of at least a portion of oxygen-enriched liquid into a vapor fraction due to latent heat exchange, work expanding at least a portion of the resulting vapor stream;

(b) work expanding a third process stream to produce additional work energy such that the total work generated along with step (a) exceeds the total refrigeration demand of the cryogenic plant and if the third process system is the same as the first process system in step (a)(1), then at least a portion of the third process stream after work expansion is not condensed against either of the two liquid streams described in step (a)(1).

In the preferred mode, only one of the methods of work expansion from steps (a)(1) and (a)(2) is used. Also the second process stream in step (a)(2) will often be the same as the first process stream in step (a)(1).

In the most preferred mode, the distillation system is comprised of a double column system consisting of a higher pressure (HP) column and a lower pressure (LP) column. At least a portion of the feed air is fed to the HP column. The product oxygen is produced from the bottom of the LP column. The first process stream in step (a)(1) or the second process stream in (a)(2) is generally a high pressure nitrogen-rich vapor stream withdrawn from the HP column. If the work expansion method of step (a)(1) is used, then the high pressure nitrogen-rich vapor stream is expanded and then condensed by latent heat exchange against a liquid stream at an intermediate height of the LP column or the crude liquid oxygen (crude LOX) stream that originates at the bottom of the HP column and forms the feed to the LP column. In this method, the pressure of the crude LOX stream is dropped to the vicinity of the LP column pressure. The high pressure nitrogen-rich stream can be partially warmed prior to expansion. If the work expansion method of step (a)(2) is used, then the high pressure nitrogen-rich stream is condensed by latent heat exchange against at least a portion of the crude LOX stream that is at a pressure higher than the LP column pressure, and the resulting vapor from the at least partial vaporization of the crude LOX is work expanded to the LP column. Prior to the work expansion, the resulting vapor from the at least partial vaporization of the crude LOX could be partially warmed. As an alternative to the crude LOX vaporization, an oxygen-enriched liquid with oxygen content greater than air could be withdrawn from the LP column and pumped to the desired pressure greater than the LP column pressure prior to at least partial vaporization.

When the most preferred mode of the double column system is used, then the third process stream in step (b) can be any suitable process stream. Some examples include: work expansion of a portion of the feed air to the LP column; work expansion of a nitrogen-rich product stream that is withdrawn from the HP column; and work expansion of a stream withdrawn from the LP column. In general, work expansion of feed to the HP column is suboptimal for this application because extra energy needs to be supplied to the incoming air.

By work expansion, it is meant that when a process stream is expanded in an expander, it generates work. This work may be dissipated in an oil brake, or used to generate electricity or used to directly compress another process stream.

Along with low-purity oxygen, other products can also be produced. This includes high purity oxygen (purity equal to or greater than 99.5%), nitrogen, argon, krypton and xenon. If needed, some liquid products such as liquid nitrogen, liquid oxygen and liquid argon could also be coproduced.

Now the invention will be described in detail with reference to FIG. 1. The compressed feed air stream free of heavier components such as water and carbon dioxide is shown as stream 100. The feed air stream is divided into two streams, 102 and 110. The major fraction of stream 102 is cooled in the main heat exchange 190 and then fed as stream 106 to the bottom of the high pressure (HP) column 196. The feed to the high pressure column is distilled into high pressure nitrogen vapor stream 150 at the top and the crude liquid oxygen (crude LOX) stream 130 at the bottom. The crude LOX stream is eventually fed to a low pressure (LP) column 198 where it is distilled to produce a lower-pressure nitrogen vapor stream 160 at the top and a liquid oxygen product stream 170 at the bottom. Alternatively, oxygen product may be withdrawn from the bottom of the LP column as vapor. The liquid oxygen product stream 170 is pumped by pump 171 to a desired pressure and then vaporized by heat exchange against a suitably pressurized process stream to provide gaseous oxygen product stream 172. In FIG. 1, the suitably pressurized process stream is a fraction of feed air in line 118. The boil-up at the bottom of the LP column is provided by condensing a first portion of the high pressure nitrogen stream from line 150 in line 152 to provide first high pressure liquid nitrogen stream 153.

According to step (a)(2) of the invention, at least a portion of the crude LOX stream having a concentration of oxygen greater than that in feed air is reduced in pressure across valve 135 to a pressure which is intermediate of the HP and LP column pressures. In FIG. 1, prior to pressure reduction, crude LOX is subcooled in subcooler 192 by heat exchange against the returning gaseous nitrogen stream from the LP column. This subcooling is optional. The pressure-reduced crude LOX stream 136 is sent to a reboiler/condenser 194, where it is at least partially boiled by the latent heat exchange against the second portion of the high pressure nitrogen stream from line 150 in line 154 (the second process stream of (a)(2) of the invention) to provide the second high pressure liquid nitrogen stream 156. The first and second high pressure liquid nitrogen streams provide the needed reflux to the HP and LP columns. The vaporized portion of the pressure-reduced crude LOX stream in line 137 (hereinafter referred to as crude GOX stream) is partially warmed in the main heat exchanger 190 and then work expanded in expander 139 to the LP column 198 as additional feed. Partial warming of crude GOX stream 137 is optional and similarly, after work expansion, stream 140 could be further cooled prior to feeding it to the LP column.

According to step (b) of the invention, a portion of the partially cooled air stream is withdrawn as stream 104 (the third process stream) from the main heat exchanger and work expanded in expander 103 and then fed to the LP column. In this figure, work extracted from each expander is sent to an electric generator. This reduces the overall electric power demand.

In FIG. 1, in order to vaporize the pumped liquid oxygen from pump 171, a portion of the feed air stream 100 in stream 110 is further boosted in an optional booster 113 and cooled against cooling water (not shown in the figure) and then cooled in the main heat exchanger 190 by heat exchange against the pumped liquid oxygen stream. A portion of the cooled liquid air stream 118 is sent to the HP column (stream 120) and another portion (stream 122) is sent to the LP column after some subcooling in subcooler 192.

Several known modifications can be applied to the example flowsheet in FIG. 1. For example, all the crude LOX stream 130 from the HP column may be sent to the LP column and none of it is sent to the reboiler/condenser 194. In lieu of this, a liquid is withdrawn from an intermediate height of the LP column and then pumped to a pressure intermediate of the HP and LP column pressures and sent to the reboiler/condenser 194. The rest of the treatment in reboiler/condenser 194 is analogous to that of stream 134, explained earlier. In another modification, the two high pressure nitrogen streams 152 and 154 condensing in reboilers/condensers 193 and 194, respectively, may not originate from the same point in the HP column. Each one may be obtained at different heights of the HP column and after condensation in their reboilers (193 and 194), each is sent to an appropriate location in the distillation system. As one example, stream 154 could be drawn from a position which is below the top location of the high pressure column, and after condensation in reboiler/condenser 194, a portion of it could be returned to an intermediate location of the HP column and the other portion sent to the LP column.

Figure 2:
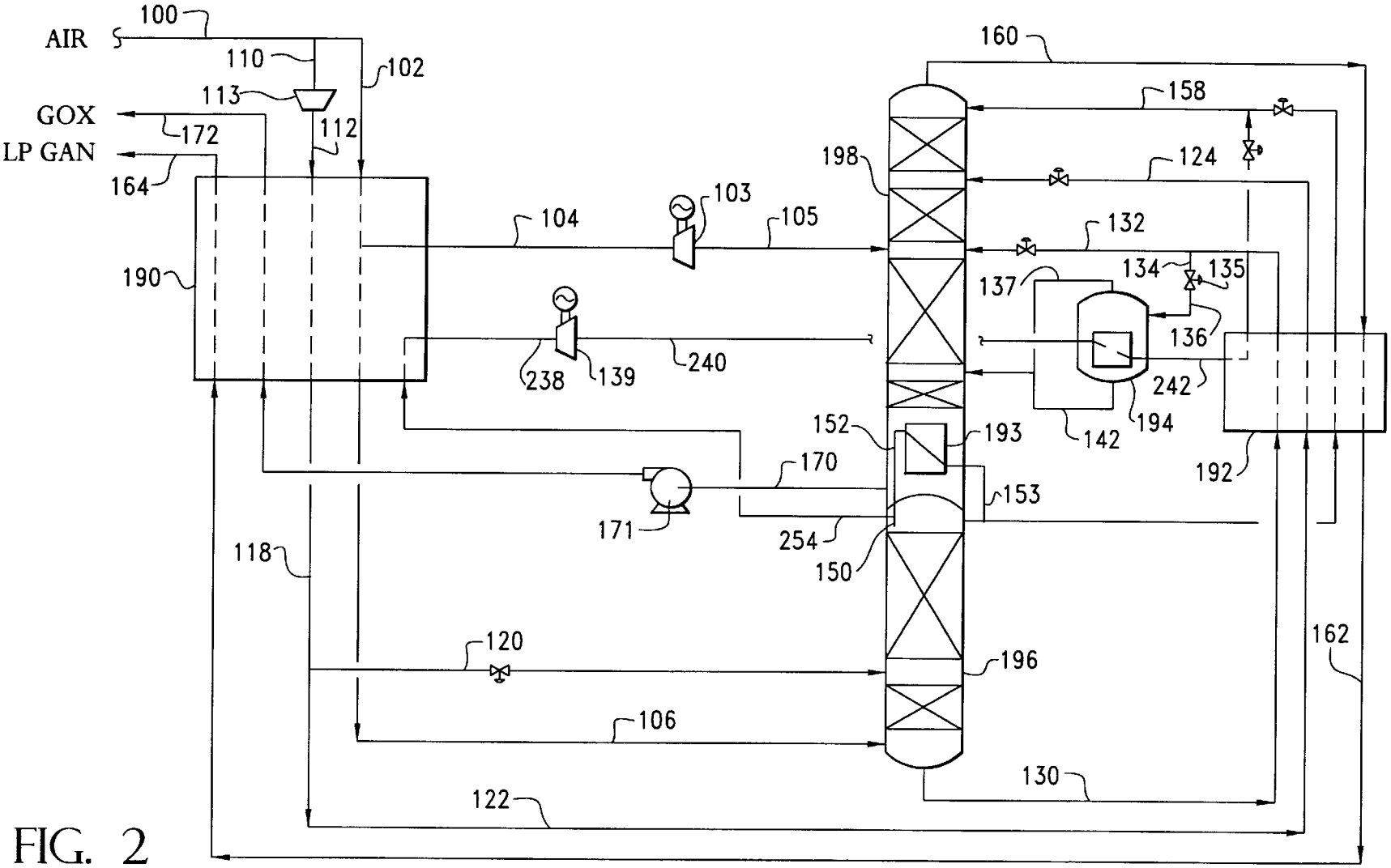

FIG. 2 shows an alternative embodiment where a process stream is work expanded according to step (a)(1). Here subcooled crude LOX stream 134 is let down in pressure across valve 135 to a pressure that is very close to the LP column pressure and then fed to the reboiler/condenser 194. The second portion of the high pressure nitrogen stream in line 154 (now the first process stream of step (a)(1)) is partially warmed (optional) in the main heat exchanger and then work expanded in expander 139 to provide a lower pressure nitrogen stream 240. This stream 240 is then condensed by latent heat exchange in reboiler/condenser 194 to provide stream 242, which after some subcooling is sent to the LP column. The vaporized stream 137 and the liquid stream 142 from the reboiler/condenser 194 are sent to an appropriate location in the LP column. If needed, a portion of the condensed nitrogen stream in line 242 could be pumped to the HP column. Once again, the two nitrogen streams, one condensing in reboiler/condenser 193 and the other condensing in reboiler/condenser 194, could be drawn from different heights of the HP column and could therefore be of different composition.

Figure 3:
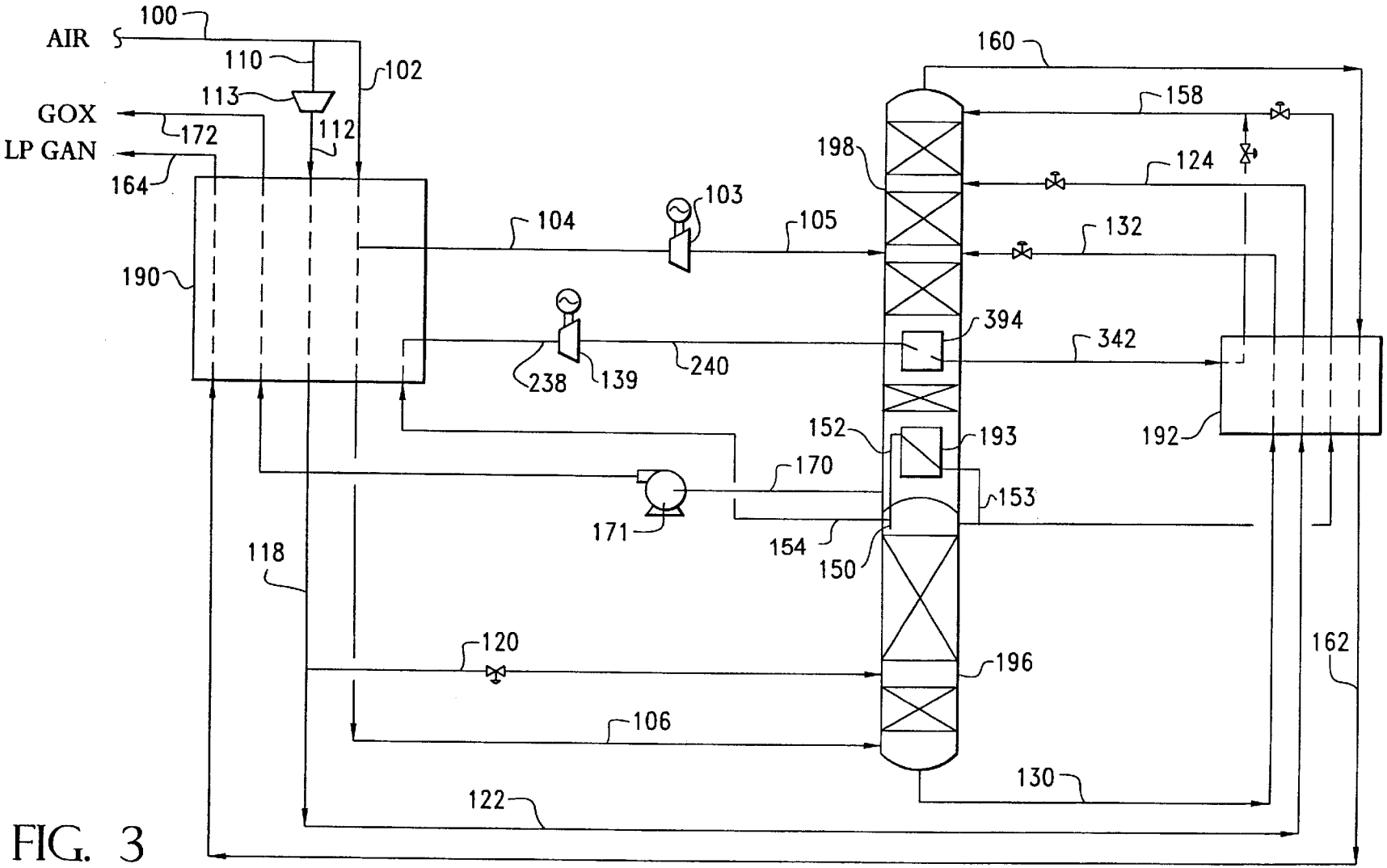

Another variation of FIG. 2 using the work expansion according to step (a)(1) is shown in FIG. 3. In this scheme, reboiler/condenser 194 is eliminated and all of the crude LOX stream from the bottom of the HP column is sent without any vaporization to the LP column. In place of reboiler/condenser 194, an intermediate reboiler 394 is used at an intermediate height of the LP column. Now the work expanded nitrogen stream 240 from expander 139 is condensed in reboiler/condenser 394 by latent heat exchange against a liquid at the intermediate height of the LP column. The condensed nitrogen stream 342 is treated in a manner which is analogous to that in FIG. 2. The other operating features of FIG. 3 are also the same as in FIG. 2.

It is possible to draw several variations of the proposed invention in FIGS. 1–3. Some of these variations will now be discussed as further examples.

Figure 4:
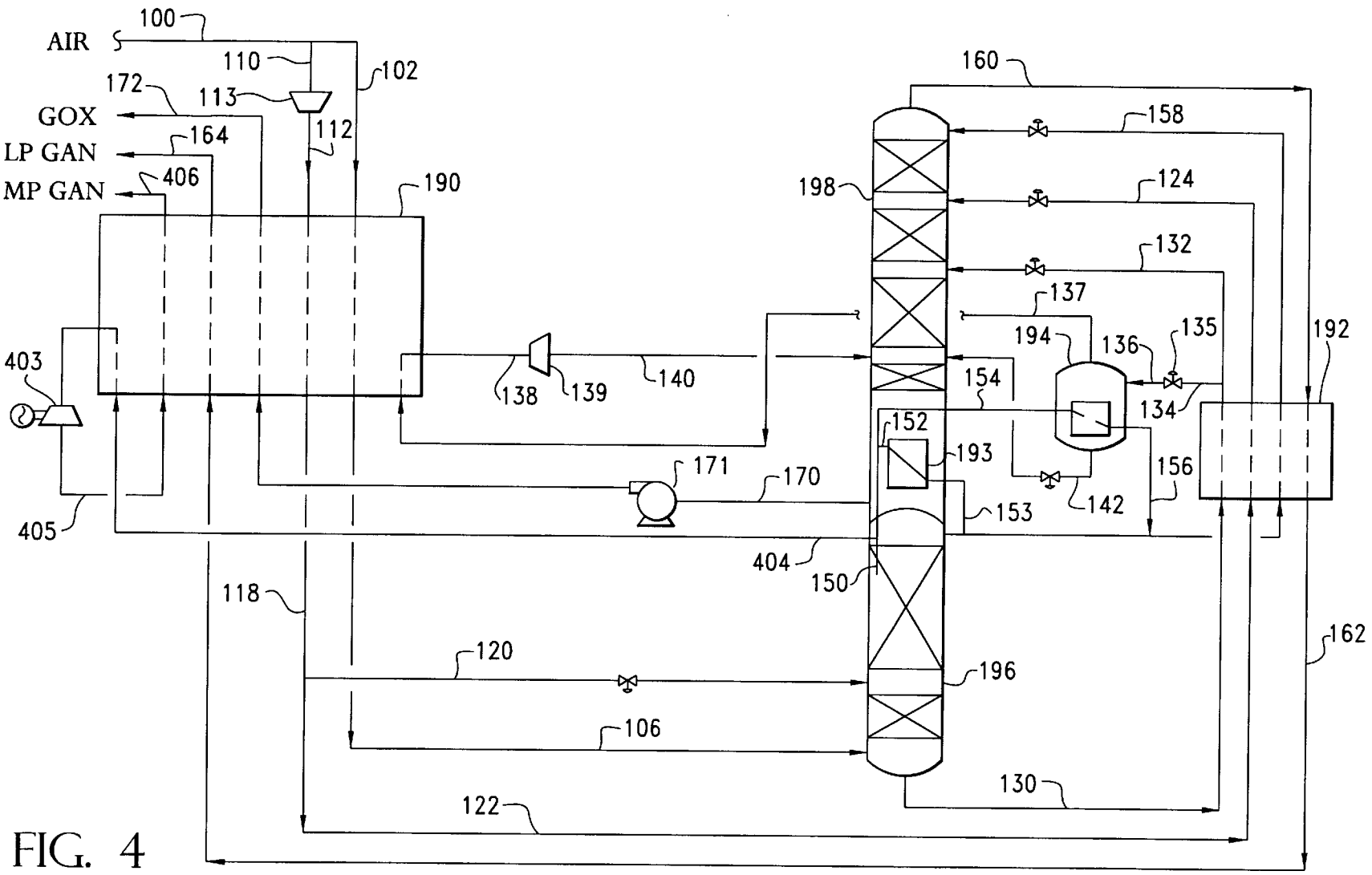

In FIGS. 1–3, expansion of a portion of the feed air to the LP column is done to meet the requirement of step (b) of the invention. As stated earlier, any suitable process stream may be expanded to meet the requirement of this step of the invention. Some examples include: work expansion of a stream from the LP or the HP column. FIG. 4 shows an example where a nitrogen-rich stream from the HP column is work expanded. FIG. 4 is analogous to FIG. 1 except that lines for streams 104 and 105 are eliminated. Instead, a portion of the high pressure nitrogen vapor is withdrawn from the top or the HP column in line 404. This stream is now the third process stream according to step (b) of the invention. The high pressure nitrogen in stream 404 is partially warmed in the main heat exchanger and then work expanded in expander 403. The work expanded stream 405 is then warmed in the main heat exchanger to provide a lower pressure nitrogen stream in line 406. The pressure of nitrogen stream 406 may be the same or different than the nitrogen in stream 164.

Figure 5:
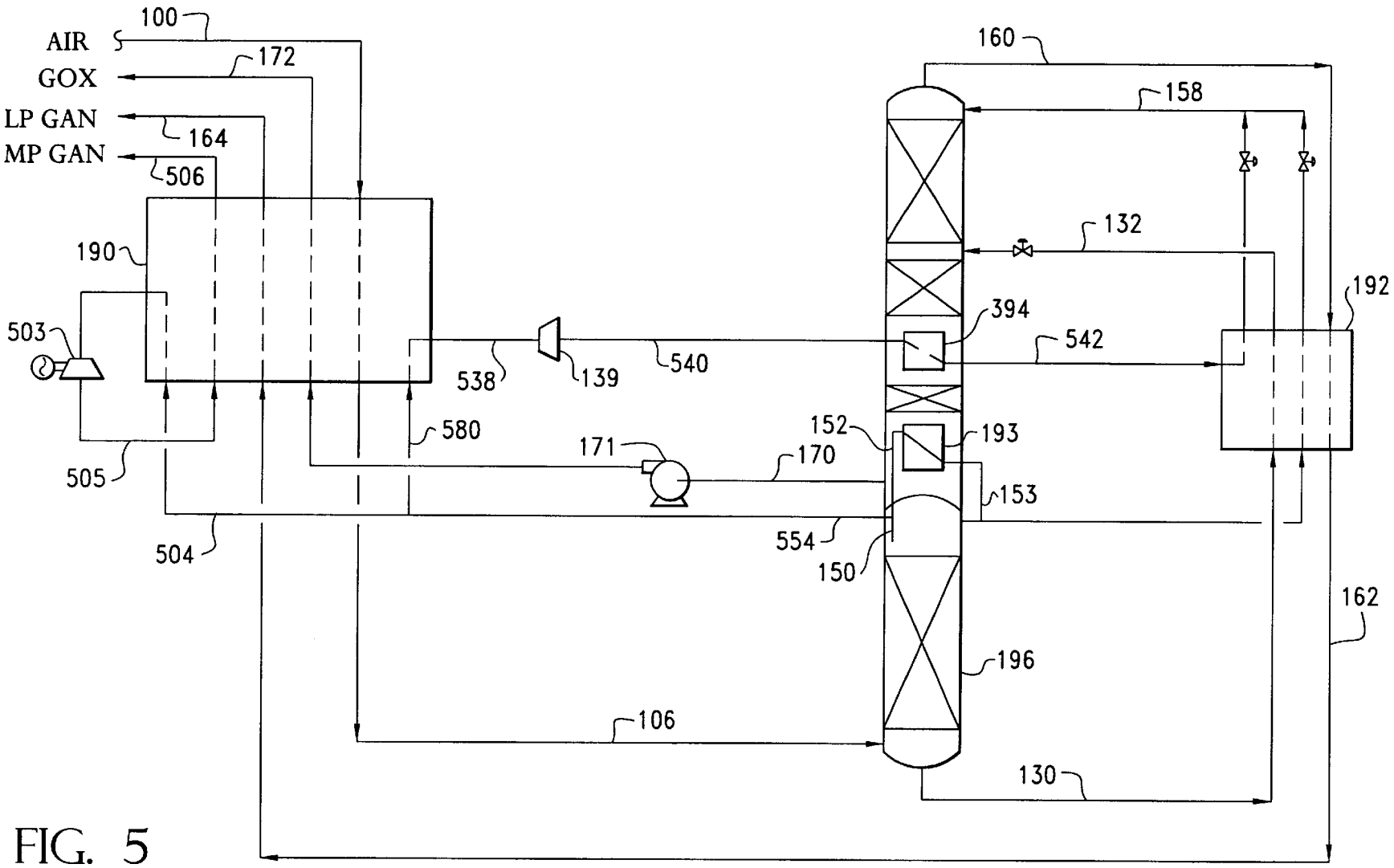

FIGS. 1–4 show examples where all the first or second process streams and the third process stream in steps (a) and (b) of the invention do not originate from the same process stream. Each of these two streams have different composition. While such schemes with different process streams can now be easily drawn, FIG. 5 shows an example where all the streams for both the steps of the invention are drawn from the top of the HP column. A portion of the high pressure nitrogen from the top of the HP column is withdrawn in line 554. This stream is then divided into two streams, 504 and 580, and both are partially warmed to their respective suitable temperatures in the main heat exchanger. After partial warming of stream 580, stream 538 provides the first process stream of step (a)(1) of the invention and is treated in a manner analogous to that of stream 238 in FIG. 3. Stream 504 provides the third process stream of step (b) of the invention and is treated in a manner analogous to that of stream 404 in FIG. 4. Note that in FIG. 5, the work expanded nitrogen stream 505 from expander 503 is not condensed against any oxygen-rich liquid from or to the LP column in a manner taught for step (a)(1) of the invention.

So far all the example flowsheets show at least two reboilers/condensers. However, it should be emphasized that the present invention does not preclude the possibility of using additional reboilers/condensers in the LP column than those shown in FIGS. 1–5. If needed, more reboilers/condensers may be used in the bottom section of the LP column to further distribute the generation of vapor in this section. Any suitable process stream may be either totally or partially condensed in these additional reboilers/condensers. Also, the possibility of condensing a vapor stream withdrawn from an intermediate height of the HP column in a reboiler/condenser located in the LP column may be considered.

In all those process schemes of the present invention, where work is extracted by the method taught in step (a)(1), all of the first process stream after work expansion may not be condensed by latent heat exchange as taught by step (a)(1). A portion of this stream may be recovered as a product stream or used for some other purpose in the process scheme. For example, in the process schemes shown in FIGS. 2–3, and 5, at least a portion of the high pressure nitrogen stream from the high pressure column is work expanded in expander 139 according to step (a)(1) of the invention. A portion of the stream exiting the expander 139 may be further warmed in the main heat exchanger and recovered as a nitrogen product at medium pressure from any one of these process flowsheets.

Figure 6:
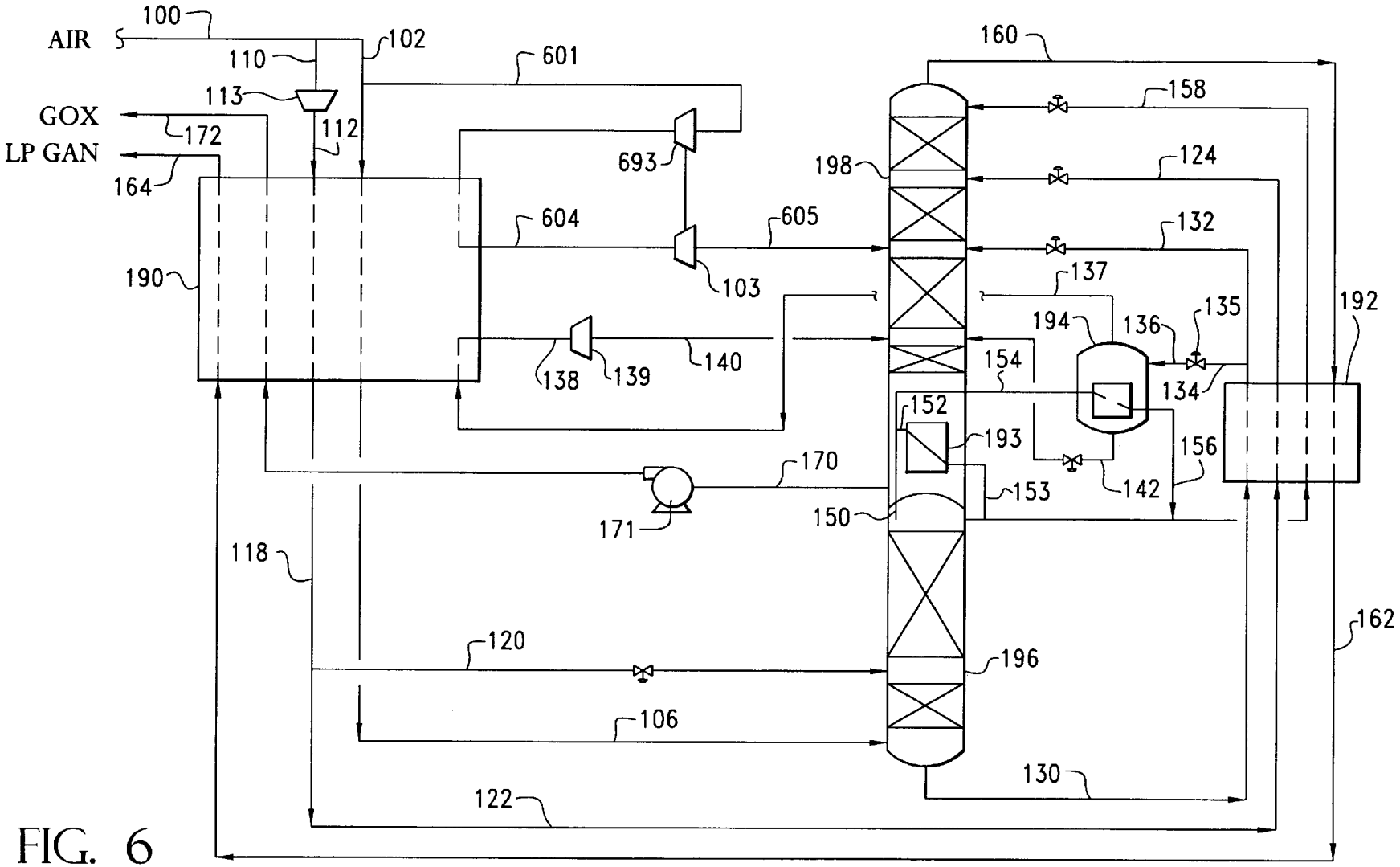

When a portion of the feed air is work expanded, it may be precompressed at near ambient temperatures, prior to feeding it to the main heat exchanger, by using the work energy that is extracted from the cold box. For example, FIG. 6 shows the process scheme of FIG. 1 except that stream 601 is withdrawn from the portion of the feed air in line 102; the withdrawn stream is then boosted in compressor 693, then cooled with cooling water (not shown in the figure) and further cooled in the main heat exchanger to provide stream 604. This stream 604 is further treated in a manner analogous to the treatment of stream 104 in FIG. 1. At least a portion of the work energy needed to drive compressor 693 is derived from the expanders in the cold box. In FIG. 6, it is shown that compressor 693 is solely driven by expander 103. An advantage of using such a system is that it provides a potential to extract more work from the expanders and therefore, the main heat exchanger's (190) volume is substantially reduced. An alternative to pressure boosting of a portion of the feed air stream in line 601, it is possible to first warm other process streams which are to be work expanded in the cold box, boost their pressure in a compressor such as 693, partially cool them in appropriate heat exchangers and then feed them to appropriate expanders.

All the work extracted from both the expanders in steps (a) and (b) of the invention is to be used external to the cold box. For this purpose, either one or both the expanders may be generator loaded to generate electricity or loaded with a warm compressor to compress a process stream at ambient or above ambient temperatures. When a process stream of either steps (a) or (b) is compressed prior to expansion in such a warm compressor, the benefit is in reduction of the main heat exchanger's volume. Some other examples of process streams that could be compressed in such a warm compressor are: the further pressurized air stream (stream 110 or 112 in FIG. 1) that eventually condenses by heat exchange with pumped liquid oxygen, a product nitrogen stream (all or a fraction of stream 164 in FIG. 1 or stream 406 in FIG. 4), a gaseous oxygen stream (line 172 in FIG. 1).

The process of the present invention is also capable of efficiently coproducing a high pressure nitrogen product stream from the HP column. This high pressure nitrogen product stream can be withdrawn from any suitable location of the HP column. This feature is not shown in any of the flowsheets 1 through 6 but is an essential part of the present invention. The novelty of using two expanders allows one to coproduce this high pressure nitrogen product more efficiently.

Finally, the method taught in this invention can be used when there are coproducts besides the low-purity oxygen, with oxygen content less than 99.5%. For example, a high purity (99.5% or greater oxygen content) oxygen could be coproduced from the distillation system. One method of accomplishing this task is to withdraw low-purity oxygen from the LP column at a location which is above the bottom and withdraw a high purity oxygen from the bottom of the LP column. If the high purity oxygen stream is withdrawn in the liquid state, then it could be further boosted in pressure by a pump and then vaporized by heat exchange against a suitable process stream. Similarly, a high purity nitrogen product stream at elevated pressure could be coproduced. One method of accomplishing this task would be to take a portion of the condensed liquid nitrogen stream from one of the suitable reboilers/condensers and pump it to the required pressure and then vaporize it by heat exchange with a suitable process stream.

Figure 7:
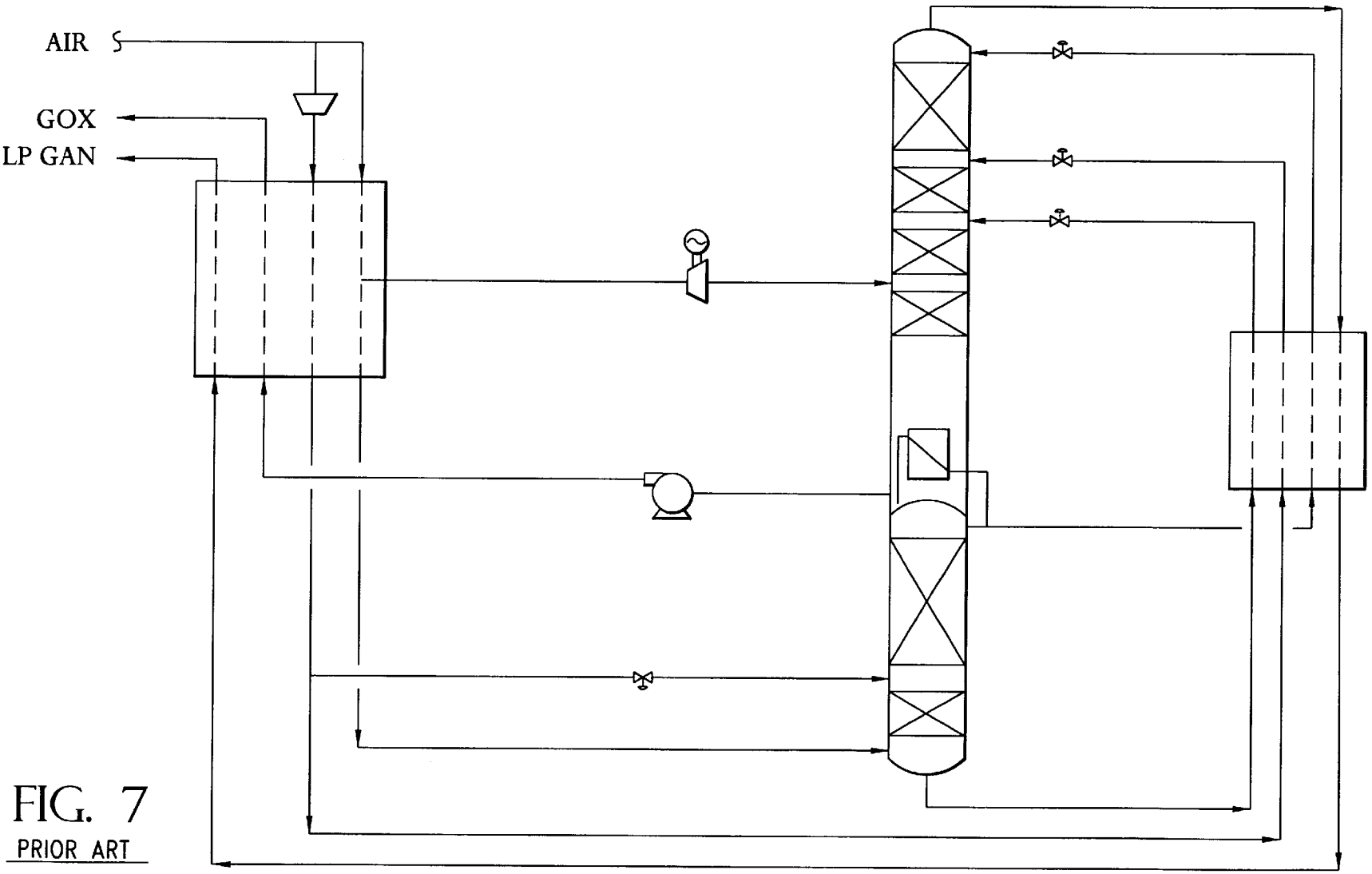
FIG. 7 PRIOR ART
FIGS. 7 and 8 illustrate schematic diagrams of two prior art processes.

The value of the present invention is that it leads to substantial reduction in the energy consumption. This will be demonstrated by comparing it with some known prior art processes, which are listed below:

The first prior art process is shown in FIG. 7. This is a conventional double column process with an air expander to the LP column. The work energy from the air expander is recovered as electrical energy. The process of FIG. 7 can be easily derived from the process of FIG. 3 by eliminating expander 139 and reboiler/condenser 394 and the associated lines.

The second prior art process is derived on the basis of Erickson's PCT/US87/011665 (U.S. Equivalent 4,796,431). For this purpose, from the process of FIG. 2, the air expander 103 is eliminated. Therefore, only one expander 139 is retained to supply the total refrigeration need of the plant. In accordance with Erickson's teaching, the discharge from expander 139 is condensed against a portion of the pressure reduced crude LOX stream 136 in reboiler/condenser 194. The condensed nitrogen stream 242 is sent as reflux to the LP column and streams 137 and 142 from the boiling side of the reboiler/condenser 194 are sent to the LP column.

Figure 8:
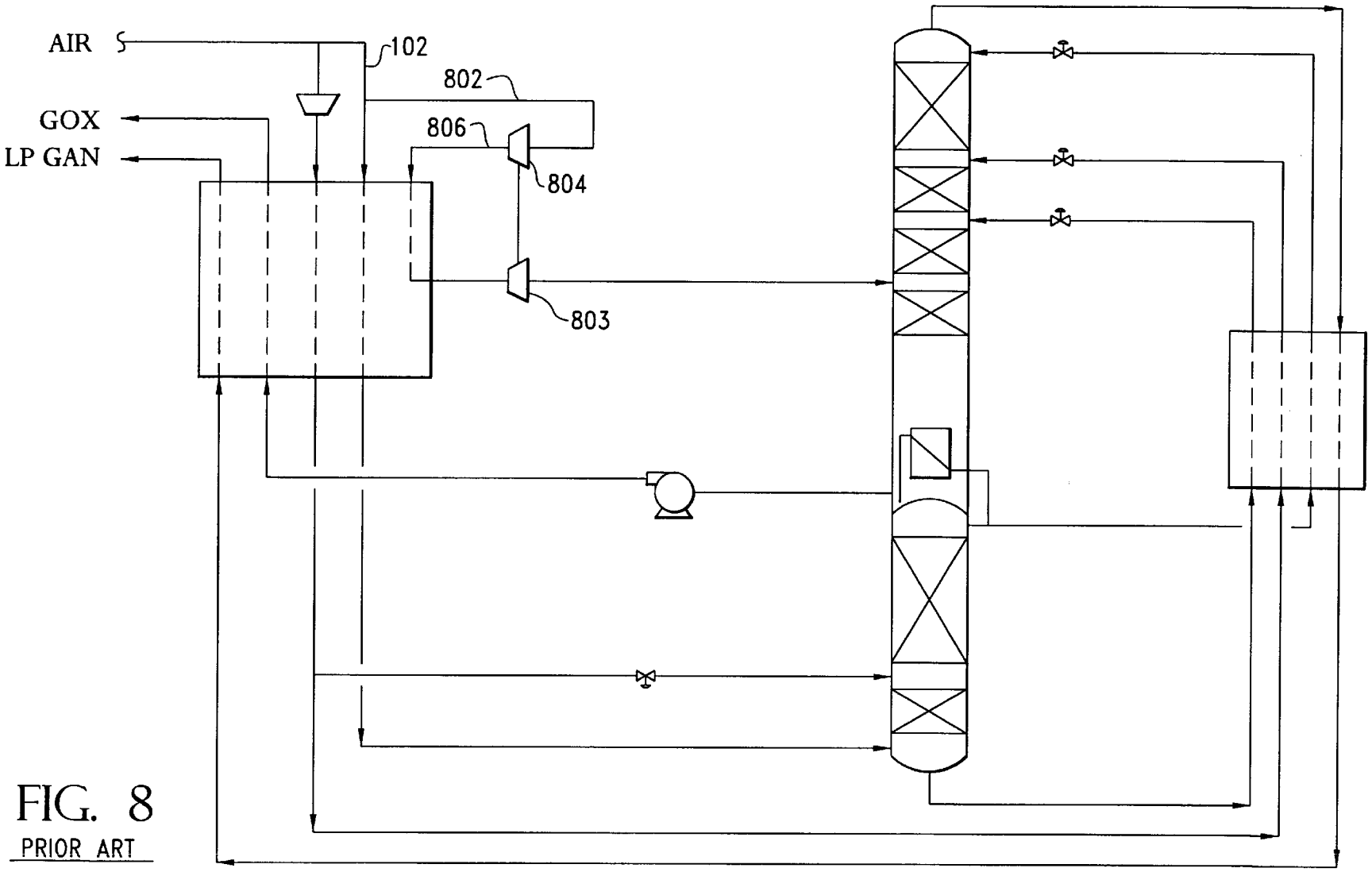
FIG. 8 PRIOR ART

The third prior art process is according to DE-2854508 and is shown in FIG. 8. This process is similar to the one shown in FIG. 7 except that the stream to be expanded is first compressed in a compressor which is mechanically linked to the expander. Thus, a portion of the feed air stream 102 is compressed in compressor 804, cooled by heat exchange with cooling water (not shown) to give stream 806. This stream is then partially cooled in the main heat exchanger, work expanded in expander 803 and fed to the LP column. Compressor 804 and expander 803 are mechanically linked and the work energy extracted from the expander is directly transferred to the compressor.

Calculations were done for the production of 2000 tons per day of 95% oxygen product at 200 psia. For all flowsheets, the discharge pressure from the final stage of the main feed air compressor was about 5.3 bar absolute. The pressure at the top of the LP column was about 1.25 bar absolute. The net power consumption was computed by calculating the power consumed in the main feed air compressor, the booster air compressor 113 to vaporize pumped liquid oxygen, and taking credit for electrical power generated from any expander. The relative power consumption and main heat exchanger volume for several flow schemes are listed below:

| Example | Flow Scheme | Relative Main Heat Exchanger Volume | Relative Power |
|---|---|---|---|
| 1 | First Prior Art (Figure 7) | 1.0 | 1.0 |
| 2 | Second Prior Art | 1.118 | 1.013 |
| 3 | Third Prior Art (Figure 8) | 0.842 | 1.031 |
| 4 | Present Invention (Figure 1) | 0.886 | 0.986 |

It is clear from these calculations that the process of the present invention is much superior to any of the prior art processes used in cases 1 through 3. Compared to the first and the second prior art processes, the present invention not only requires less power but also uses less main heat exchanger volume. This makes the invention both energy efficient and cost effective. For large size plants, it is highly desirable to have both the reduction in main heat exchanger volume and energy consumption. As compared to the third prior art process, the process of present invention requires 4.4% less power at comparable main heat exchanger volume. If it was desirable to further reduce the main heat exchanger volume, the work output from either one or both the expanders could be used to compress a portion of the air stream which is eventually expanded; one such example is shown in FIG. 6. The process in FIG. 6 is capable of giving both lower power and main heat exchanger volume when compared to the third prior art of FIG. 8.

The present invention is neither taught nor suggested by literature. Erickson (PCT/U.S. 87/01665) mentions in passing the use of air expander only when the other expander cannot provide all required refrigeration. We do not have that case here. It is clear from the second prior art example that an expander such as 139 in FIG. 2 is easily capable of providing all the needed refrigeration alone when products are predominantly gaseous. The same is true for the air expander in examples 1 and 3. Erickson did not teach nor suggest that the use of two expanders as taught in this example would reduce power demand as well as main heat exchanger volume. In fact, Jakob (U.S. Pat. No. 2,753,698) teaches that when an expander such as 139 in FIG. 1 is used to expand boiled crude GOX, the improvement is obtained because air expander is not used and total air is prefractionated in the HP column. Clearly the result in example 4 for the present invention is not taught nor suggested by Jakob's U.S. Pat. No. 2,753,698. DE-2854508 teaches that the flowsheet in FIG. 8 provides additional refrigeration to produce liquid products or increase product recovery. Indeed the recovery of oxygen in the example 3 (third prior art) is 98.04% which is higher than 95.88% for example 4 (present invention). However, DE-2854508 consumes more power for low purity gaseous oxygen production. The great energy savings while using similar main heat exchanger volume is not taught or suggested by DE-2854508.

The present invention is particularly more useful when the HP column pressure is greater than about 63 psia (4.3 bar absolute) and less than about 160 psia (11 bar absolute). The reason being that generally a high pressure column less than 63 psia means that a portion of the feed air stream is condensed in the bottom reboiler of the LP column. This decreases the amount of liquid nitrogen reflux available to the distillation columns. Therefore, the absence of an air expander allows more air to be added to the HP column which helps create more liquid nitrogen reflux. Furthermore, since inlet pressure to expanders is now lower, the amount of work extracted is not large. For HP column pressures greater than 160 psia, the need for liquid nitrogen reflux by the distillation column increases sharply and in this case, use of a feed air expander to the LP column could become unattractive.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

We claim:

1. In a process for the cryogenic distillation of air in a distillation column system that contains at least one distillation column wherein the boil-up at the bottom of the distillation column producing the oxygen product is provided by condensing a stream whose nitrogen concentration is equal to or greater than that in the feed air stream, the improvement which comprises the steps of:

(a) generating work energy which is at least ten percent (10%) of the overall refrigeration demand of the distillation column system by at least one of the following two methods:

(1) work expanding a first process stream with nitrogen content equal to or greater than that in the feed air and then condensing at least a portion of the expanded stream by latent heat exchange with at least one of the two liquids: (i) a liquid at an intermediate height in the distillation column producing oxygen product and (ii) one of the liquid feeds to this distillation column having an oxygen concentration equal to or preferably greater than the concentration of oxygen in the feed air; and (2) condensing at least a second process stream with nitrogen content equal to or greater than that in the feed air by latent heat exchange with at least a portion of an oxygen-enriched liquid stream which has oxygen concentration equal to or preferably greater than the concentration of oxygen in the feed air and which is also at a pressure greater than the pressure of the distillation column producing oxygen product, and after vaporization of at least a portion of oxygen-enriched liquid into a vapor fraction due to latent heat exchange, work expanding at least a portion of the resulting vapor stream;

(b) work expanding a third process stream to produce additional work energy such that the total work generated along with step (a) exceeds the total refrigeration demand of the cryogenic plant and if the third process system is the same as the first process system in step (a)(1) then at least a portion of the third process stream after work expansion is not condensed against either of the two liquid streams described in step (a)(1).

2. The process according to claim 1 wherein the distillation column system comprises a higher pressure column and lower pressure column.

3. The process according to claim 2 wherein the first process stream in step (a)(1) is a vapor stream withdrawn from the higher pressure column.

4. The process according to claim 2 wherein the first process stream in step (a)(1) is a portion of feed air.

5. The process according to claim 2 wherein the first process stream in step (a)(1) is the vapor resulting from the partial condensation of at least a portion of feed air.

6. The process according to claim 2 wherein said first process stream is condensed by at least partially vaporizing a liquid derived from an intermediate location of the lower pressure column.

7. The process according to claim 2 wherein said first process stream is condensed by at least partially vaporizing at least a portion of an oxygen enriched liquid which is withdrawn from the higher pressure column.

8. The process according to claim 2 wherein said first process stream is condensed by at least partially vaporizing at least a portion of an oxygen enriched liquid which is derived from at least partially condensing at least a portion of the feed air.

9. The process according to claim 2 wherein at least a portion of said first process stream is pumped and sent to the higher pressure column after condensation.

10. The process according to claim 2 wherein at least a portion of said first process stream is pumped and vaporized in a heat exchanger to provide a product.

11. The process according to claim 2 wherein all of said first process stream is sent to the lower pressure column as a feed after condensation.

12. The process according to claim 2 wherein the second process stream in step (a)(2) is a vapor withdrawn from the higher pressure column.

13. The process according to claim 2 wherein the second process stream in step (a)(2) is a portion of feed air at a pressure less than the higher pressure column.

14. The process according to claim 2 wherein the second process stream in step (a)(2) is the vapor resulting from the partial condensation of at least a portion of feed air and said vapor is at a pressure less than the higher pressure column.

15. The process according to claim 2 wherein said second process stream has been turbo expanded prior to condensation.

16. The process according to claim 2 wherein said second process stream is condensed by at least partially vaporizing a liquid derived from an intermediate location of the lower column and said liquid is pumped prior to vaporization.

17. The process according to claim 2 wherein said second process stream is condensed by at least partially vaporizing at least a portion of an oxygen enriched liquid which is withdrawn from the higher pressure column.

18. The process according to claim 2 wherein said second process stream is condensed by at least partially vaporizing at least a portion of an oxygen enriched liquid which is derived from at least partially condensing at least a portion of the feed air.

19. The process according to claim 2 wherein at least a portion of said second process stream is pumped, if necessary, and sent to the higher pressure column after condensation.

20. The process according to claim 2 wherein at least a portion of said second process stream is pumped and vaporized in a heat exchanger to provide a product.

21. The process according to claim 2 wherein all of said second process stream is sent to the lower pressure column as a feed after condensation.

* * * * *